United States Patent [19]

Penick

[11] Patent Number: 4,597,854

[45] Date of Patent: Jul. 1, 1986

[54] MULTI-BED HYDRODEWAXING PROCESS

[75] Inventor: Joe E. Penick, Princeton, N.J.

[73] Assignee: Mobil Oil Corporation, New York, N.Y.

[21] Appl. No.: 755,767

[22] Filed: Jul. 17, 1985

[51] Int. Cl.[4] ..... C10G 13/02; C10G 23/02

[52] U.S. Cl. ..... 208/58; 208/111; 208/109; 208/59

[58] Field of Search ..... 208/58, 59, 109, 110, 208/147, 111

[56] References Cited

U.S. PATENT DOCUMENTS

| | | | |
|---|---|---|---|
| 3,248,316 | 4/1966 | Barger, Jr. et al. | 208/58 |
| 3,498,755 | 3/1970 | Borre | 23/288 |
| 3,728,249 | 4/1973 | Antezana et al. | 208/59 X |
| 3,894,937 | 7/1975 | Bonacci et al. | 208/89 |
| 3,983,029 | 9/1976 | White | 208/59 |
| 4,229,282 | 10/1980 | Peters et al. | 208/111 |
| 4,257,872 | 3/1981 | La Pierre et al. | 208/59 |
| 4,283,271 | 8/1981 | Garwood et al. | 208/59 |
| 4,292,166 | 9/1981 | Gorring et al. | 208/59 |
| 4,313,817 | 2/1982 | Mayer et al. | 208/89 |
| 4,347,121 | 8/1982 | Mayer et al. | 208/59 X |
| 4,436,614 | 3/1984 | Olbrich et al. | 208/89 |
| 4,437,976 | 3/1984 | Oleck et al. | 208/97 |
| 4,457,829 | 7/1984 | Abrams | 208/59 X |
| 4,490,242 | 12/1984 | Okeck et al. | 208/97 |

*Primary Examiner*—Andrew H. Metz
*Assistant Examiner*—Glenn A. Caldarola
*Attorney, Agent, or Firm*—A. J. McKillop; M. G. Gilman; L. G. Wise

[57] ABSTRACT

Catalytic dewaxing of hydrocarbon oils is effected with intermediate hydrotreating. A continuous multi-bed technique employs alternating beds of dewaxing and hydrogenation catalysts to improve process performance, whereby partially dewaxed effluent is treated to decrease coke deposits.

12 Claims, 3 Drawing Figures

MULTI-BED HYDRODEWAXING PROCESS

FIELD OF THE INVENTION

This invention relates to a process for dewaxing hydrocarbon oils. In particular, it relates to catalytic hydrodewaxing of petroleum oils to produce low pour point distillate and lubricating oil stocks.

BACKGROUND OF THE INVENTION

Dewaxing is often required when paraffinic oils are to be used in products which need to have good fluid properties at low temperatures e.g. lubricating oils, heating oils, jet fuels. The higher molecular weight straight chain normal and slightly branched paraffins which are present in oils of this kind are waxes which are the cause of high pour points in the oils. If adequately low pour points are to be obtained, these waxes must be wholly or partly removed. In the past, various solvent removal techniques were used e.g. propane dewaxing, MEK dewaxing; but, the decrease in demand for petroleum waxes, together with the increased demand for gasoline and distillate fuels, has made it desirable to find economic processes which convert waxy components into other materials of higher value. Catalytic dewaxing processes can achieve this by selectively cracking the longer chain paraffins, to produce lower molecular weight products which may be removed by distillation. Processes of this kind are described, for example, in The Oil and Gas Journal, Jan. 6, 1975; pages 69 to 73 an U.S. Pat. No. 3,668,113.

It is also known to produce a high quality lube base stock oil by subjecting a waxy crude oil fraction to solvent refining, followed by catalytic hydrodewaxing (HDW) over ZSM-5, with subsequent hydrotreating (HDT) of the lube base stock, as taught in U.S. Pat. No. 4,181,598, the entire contents of which is incorporated herein by reference.

In order to obtain the desired selectivity, the catalyst has usually been a zeolite having a pore size which admits the straight chain n-paraffins either alone or with only slightly branched chain paraffins, but which generally excludes more highly branched materials, cycloaliphatics and heavy aromatics. Shape-selective zeolites such as ZSM-5, ZSM-11, ZSM-12, ZSM-23, ZSM-35 and ZSM-38 have been proposed for this purpose in dewaxing processes and their use is described in U.S. Pat. Nos. 3,894,938; 4,176,050; 4,181,598; 4,222,855; 4,229,282, 4,247,388, 4,257,872, 4,313,817, 4,436,614, and 4,490,242, incorporated herein by reference. A dewaxing process employing synthetic offretite is described in U.S. Pat. No. 4,259,174. A hydrocracking process employing zeolite beta as the acidic component is described in U.S. Pat. No. 3,923,641.

Dewaxing processes of this kind function by cracking waxy components to form lower molecular weight materials, including olefins and other unsaturated compounds which contribute to deactivation of the catalyst. Cracking products, especially lower olefins, tend to further degrade to form carbonaceous deposits on the catalyst. Coking deactivates the catalyst requiring the process temperature to be raised in order to achieve the desired degree of conversion. As the aging of the catalyst has resulted in the process temperature increasing to an upper limit, the production process is interrupted to permit periodic oxidative regeneration of the catalyst. Frequent shutdown of the production unit for catalyst regeneration can render the dewaxing process less economic.

Prior work has established the value of metal-exchanged and/or impregnated zeolites, especially acidic Ni-ZSM-5 zeolite, as a hydrodewaxing catalyst. Pd-exchanged ZSM-5 has a lower aging rate than other Group VIII metals, but this requires extra catalyst processing beyond that of the economic standard zeolites employed in commercial HDW processes. It has also been proposed to admix a hydrogenation catalyst, such as palladium on alumina, with a standard HDW catalyst; however, this poses problems in catalyst loading and regeneration techniques. Density differences between the two catalysts make mixed loading difficult.

It is an object of the present invention to improve the catalytic hydrodewaxing process by extending the useful production cycle. This can be achieved by the discovery that staged conversion in a multi-bed dewaxing reactor system with an intermediate catalytic hydrotreating zone operatively connected between alternating beds of dewaxing catalyst can improve performance, resulting in improved aging characteristics.

BRIEF SUMMARY OF THE INVENTION

A continuous cascading multi-bed technique has been found for catalytic hydrodewaxing of waxy feedstock, such as petroleum oils. The improvement comprises methods and means for partially dewaxing the feedstock by contacting the feedstock at elevated temperature with a first medium pore crystalline zeolite catalyst bed in the presence of hydrogen, subsequently contacting the partially dewaxed effluent from the first bed with at least one separate hydrogenation catalyst bed under hydrotreating conditions further dewaxing the hydrotreated feedstock in at least one additional catalytic dewaxing bed, further hydrogenating the dewaxed feedstock in an additional hydrotreating step. Advantageously, all of the process conversion steps are conducted in a reactor shell having stacked alternating operatively-connected beds of hydrodewaxing zeolite catalyst and hydrogenation catalyst under controlled temperature conditions. This process may employ quenching hydrogen introduced between stages to cool cascaded dewaxed effluent prior to hydrotreating.

By employing the cascade sequence of alternating HDW and HDT beds, olefinic precursors of coke are hydrogenated to saturated aliphatics and the aging rate of subsequently contacted dewaxing catalyst is decreased significantly.

These and other objects and advantages of the inventions are demonstrated in the following description and attached drawing.

DESCRIPTION OF PREFERRED EMBODIMENTS

Figure 1:
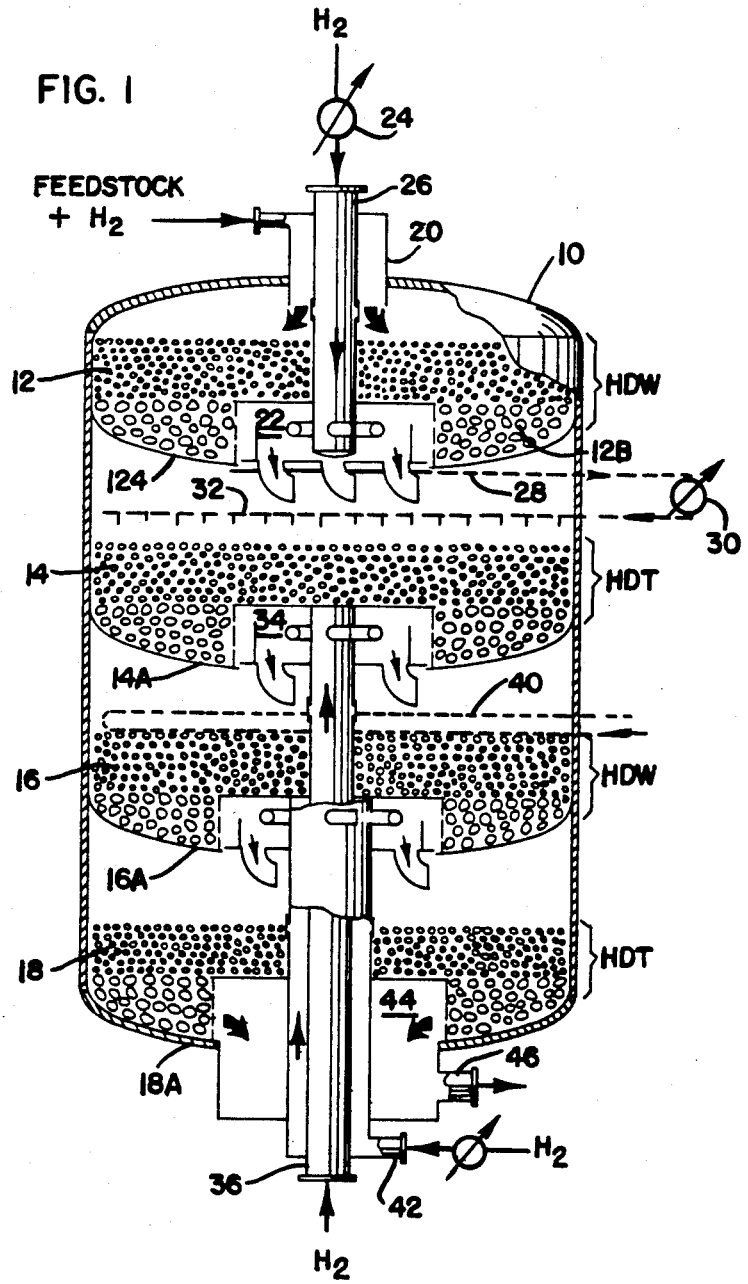
FIG. 1 is a vertical cross-section view of a cylindrical reactor vessel showing the disposition of catalyst, flow streams and major equipment schematically.

In the embodiment depicted in the drawing a vertical downflow reactor vessel 10 is fabricated as a cylindrical shell having a plurality of stacked serially-connected catalytic zones 12, 14, 16, 18. Each of these operating zones includes support means 12A, 14A, 16A, 18A for retaining a fixed bed of solid catalyst particles. Feedstock and $H_2$-containing reactant gas may be introduced at conversion conditions at elevated temperature and pressure though top feed inlet means 20, which may include a distributor means (not shown) for applying the fluid phases across the top of a first solid catalyst bed in zone 12. In a preferred embodiment, the catalyst bed for the hydrodewaxing (HDW) zone is a medium pore crystalline zeolite, such as acidic nickel ZSM-5 or the like. A typical supported catalyst bed may be 1–5 mm extrudate zeolite/alumina on a porous bed of larger inert particles (i.e. ceramic balls) 12B, through which reaction products are withdrawn via plenum 22. The partially treated effluent from the first catalyst zone 12 cascades into the second hydrotreating (HDT) zone 14. The effluent way be cooled by injecting additional cold gas (e.g. $H_2$) via heat exchanger 24 and coaxial inlet 26 which extends vertically through the reactor shell top into the plenum space 22. The cold fluid quenches at least a portion of the hot first stage effluent to the desired hydrotreating temperature. Optionally, the liquid phase may be separately collected and withdrawn via conduit 28, passed through heat exchanger 30 and redistributed over the second catalyst bed 14 by sprayheader 32 or similar liquid distributor means. Liquid distribution may be used in any of the beds, if desired. The partially converted first zone effluent is then treated in contact with a second catalyst, such as hydrogenation catalyst supported in intermediate bed 14.

Hydrotreated effluent from the second reactor zone is then combined in the second plenum 34 with hot hydrogen from a bottom coaxial inlet means 36 to raise the cascaded effluent to a higher temperature in the subsequent HDW zone 16. Optionally, supplemental heat can be supplied by contacting the reactants with heating tube 40, which may have a heat exchange fluid flowing therethrough. Heat exchanger tubes may be employed in the other zones, if desired. Various techniques are known for controlling reaction temperature for exothermic and endothermic conversions. Tubular reactors may be employed to maintain isothermal conditions by thermal conduction through the reactor walls. Following further conversion in the final HDW zone, the hot effluent from zone 16 is cooled by quench hydrogen via inlet 42 in a manner similar to the handling of the first zone effluent. The catalytically dewaxed and hydrotreated product is recovered from the reactor via bottom plenum 44 and outlet conduit 46.

In addition to the above-described reactor system, other reaction equipment and operating techniques are disclosed in U.S. Pat. Nos. 3,498,755 (Borre), and 3,894,937 (Bonacci et al), incorporated herein by reference.

The hydrodewaxing catalysts preferred for use herein include the crystalline aluminosilicate zeolites having a silica to alumina ratio of at least 12, a constraint index of about 1 to 12 and acid cracking activity ($\alpha$) of about 10 to 200, preferably about 50 to 100. Representative of the ZSM-5 type zeolites are ZSM-5, ZSM-11, ZSM-12, ZSM-23, ZSM-35 and ZSM-38. ZSM-5 is disclosed in U.S. Pat. No. 3,702,886 and U.S Pat. No. Re. 29,948; ZSM-11 is disclosed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,839 for ZSM-38. The disclosures of these patents are incorporated herein by reference. A suitable shape selective medium pore HDW catalyst for fixed bed is Ni-exchanged HZSM-5 zeolite with alumina binder in the form of cylindrical extrudates of about 1–5 mm. Other pentasil catalysts which may be used in one or more reactor stages include a variety of medium pore (~5 to 9A) siliceous materials, such as borosilicates, ferrosilicates, and/or gallo-silicates.

The hydrotreating catalysts employed are typically metals or metal oxides of Group VIB and/or Group VIII deposited on a solid porous support such as silica and/or metal oxides such as alumina, titania, zirconia or mixtures thereof. Representative Group VIB metals include molybdenum, chromium and tungsten and Group VIII metals include nickel, cobalt, palladium and platinum. These metal components are deposited, in the form of metals or metal oxides, on the indicated supports in amounts generally between about 0.1 and about 20 weight percent.

The multiple catalyst bed cascade process of this invention is conducted at a pressure within the approximate range of 800 to 20,000 kPa (100 to 3000 psig). The temperature is generally within the approximate range of 200° to 450° C., with an increasing temperature gradient, as the feed passes initially through individually adiabatic beds of hydrotreating catalyst and hydrodewaxing catalyst. Suitably, the temperature of the HDT beds will be within the range of 200° to 450° C. and the HDW beds will be about 250° C. to 400° C. The feed is conducted through the catalyst beds at an overall space velocity between about 0.1 and about 10 parts by weight of feed hourly flow per weight of active catalyst, and preferably between about 0.2 and about 2 WHSV, along with hydrogen present in the various zones in an amount between about 2 and 25 moles of hydrogen per mole of hydrocarbon.

Initial hydrotreating of the hydrocarbon feed prior to the first HDW bed serves to convert heteroatom-hydrocarbon compounds to gaseous products and converts some hydrocarbons to lighter fractions. The effluent from the initial hydrotreating zone can be cascaded directly to the first HDW stage, or the effluent may be topped by flashing or fractionating to remove the light by-products (low boiling hydrocarbons, $H_2S$, $NH_3$, etc.).

In order to demonstrate the inventive concept, a series of experimental runs is conducted for dewaxing a heavy neutral gas oil (Arab light crude oil stock) by a conventional HDW process and the alternating HDW-HDT technique of this invention. In all the continuous runs the standard dewaxing catalyst is a steamed Ni-containing ZSM-5 having a silica-alumina mole ratio of 70:1 and an acid cracking activity (alpha-value) of about 98. This catalyst is composited with alumina (35%) to form an extrudate (about 1.5 mm diameter), available from Mobil Chemical Co.

The process is conducted in a tubular reactor under substantially isothermal conditions by heat exchange with the walls of a thermally conductive tube 2.2 cm I.D. ($\frac{7}{8}$ inch). The HDT catalyst is a standard $Pd/Al_2O_3$ catalyst available as a 3 mm extrudate (Engelhard Industries). The palladium loading is about 0.5 wt %. The tubular reactor is prepared by sulfiding the HDW catalyst at about 230° to 345° C. with 2% $H_2S$ in $H_2$ at 2900 kPa. After reaching steady state continuous flow conditions at about 200° C., the charge stock is introduced at about 1.6 WHSV (based on Ni-ZSM-5) with hydrogen reactant (445 $nM^3/M^3$) and the reactor temperature is initially increased to 290° C. to meet a desired pour point of about −6° C. Thereafter the reactor temperature is adjusted incrementally to maintain the pour point desired. The alternating layers of HDW catalyst and HDT catalyst are loaded by uniformly mixed the Pd or NiZSM-5 extrudates with 80/120 mesh silica sand at a volume ratio of about 3:1. The alternating layers are retained by mesh screens at opposing ends and comprise 4 HDT layers between 5 alternating HDW layers, with the total weight of the HDW and HDT catalysts being equal.

Figure 2:
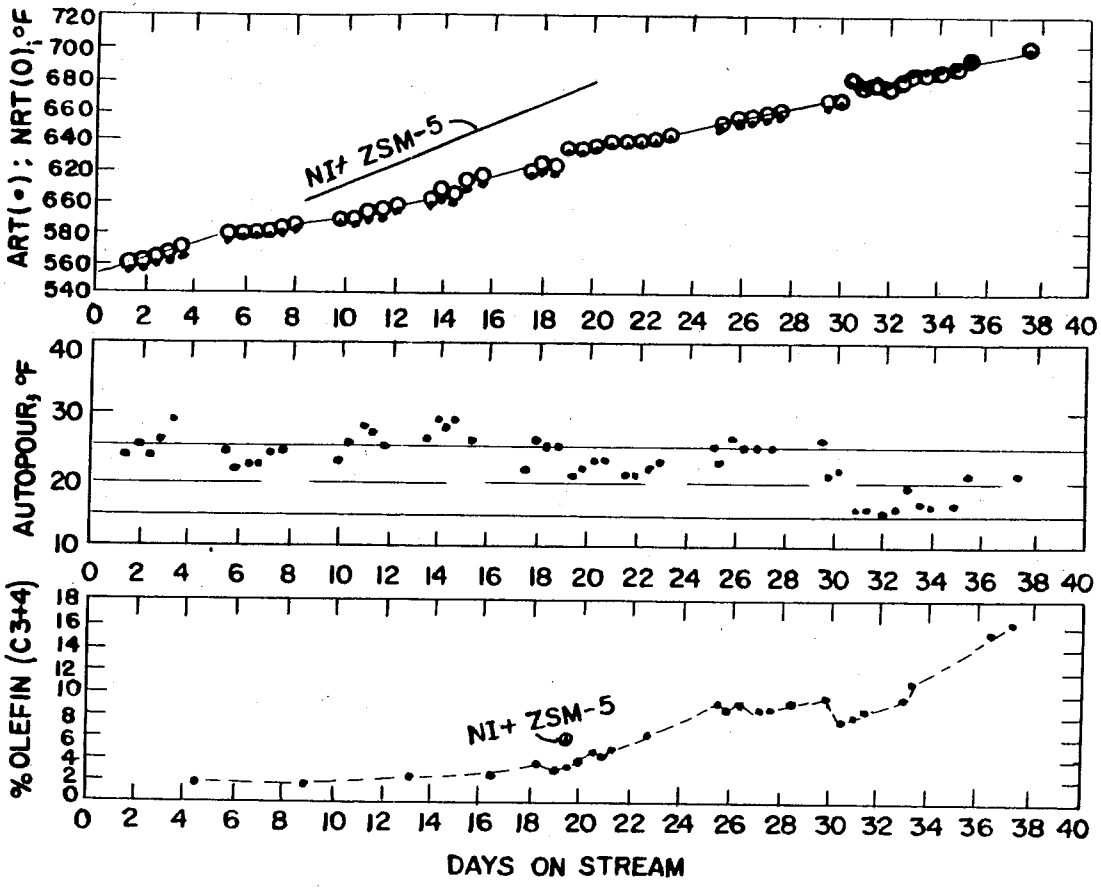
FIG. 2 is a graphic plot of process variables vs. time on stream, showing catalyst aging.

FIG. 2 shows the start-of-cycle-(SOC) catalyst activity and aging behavior for dewaxing the heavy neutral petroleum feedstock over the alternating layer-bed reactor and conventional catalyst bed to pour point. Actual reactor temperature (ART) and normalized reactor temperature (NRT) are plotted at the top for the alternating HDW-HDT configuration, with corresponding plots for pour point and $C_3+C_4$ olefin offgas data during the continuous run. As compared to dewaxing heavy neutral over Ni-ZSM-5 alone (solid line), the layered mixed-catalyst system has about the same SOC activity, being only slightly more active, but has a 45% slower aging rate (2° vs. 3.5° C./day). The light gas olefinic content (measured as % olefins in $C_3+C_4$ hydrocarbons) is about two-thirds that of Ni-ZSM-5 alone, demonstrating that Pd can have a beneficial effect without being in intimate contact with the zeolite. This indicates detrimental effects of olefin and their by-products on conventional dewaxing activity and catalyst aging.

As shown in FIG. 2, programmed reactor temperature increase, while sufficient to maintain product pour point approximately constant, is not adequate to keep the $C_3$–$C_4$ olefins from increasing significantly with time on stream, indicating that hydrogenation activity of $Pd/Al_2O_3$ ages faster than dewaxing activity of Ni/ZSM-5.

Figure 3:
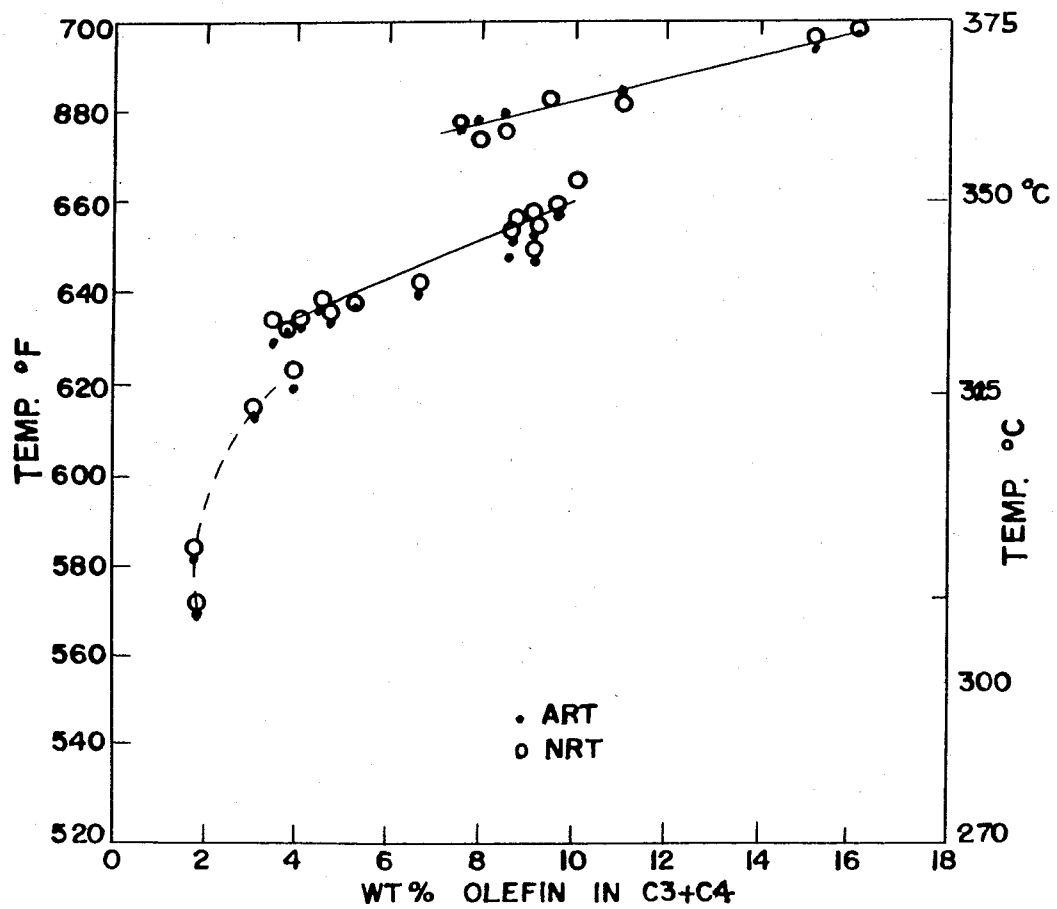
FIG. 3 is a plot of reactor temperature vs. $C_3$–$C_4$ olefin content for the alternating layer bed HDW-HDT process.

FIG. 2 also reveals that the aging cycle has two segments according to days on stream. During the first segment (days 0–5), the catalyst undergoes a rapid transient aging at about the same rate as Ni-ZSM-5 alone. The aging rates during the second segment (days 5–38) becomes smaller. When the reactor temperatures required to meet −6.7° C. (20° F.) pour throughout the whole dewaxing cycle are plotted against the corresponding % olefins in $C_3+C_4$, as shown in FIG. 3, the reactor temperatures are approximately linearly proportional to % olefins in $C_3+C_4$. It is believed that the increasing olefinic concentration exerts a greater inhibition on the dewaxing activity and thereby requires a higher reactor temperature to meet the target pour. Olefinic inhibition that affects dewaxing activity may also affect dewaxing aging.

Product composition data shown in Table I are obtained from distillation cuts of material-balance total-liquid product and show that the light product compositions for alternating HDW-HDT reactors are somewhat different, being higher in paraffins and lower in naphthenes and aromatics. This is consistent with the function of $Pd/Al_2O_3$ which hydrogenates the bulk-phase olefins and thereby decreases the extent of olefinic cyclization and aromatization reactions. The lube fraction compositions of the layered-catalyst system is about the same as those of Ni/ZSM-5 alone.

TABLE I

Naphtha and Distillate Compositional Data

| Composition, wt % | Layered HDW/HDT Catalyst | Ni/ZSM-5/(HDW) |
|---|---|---|
| Naphtha 52–207° C. (125–405° F.) | | |
| Paraffins | 42% | 30% |
| Olefins | 4 | 6 |
| Naphthenes | 39 | 38 |
| Aromatics | 15 | 26 |
| Distillate 207–343° C. (405–650° F.) | | |
| Nonaromatics | 58 | 53 |
| Aromatics | 42 | 47 |
| 343° C.+ (650° F.+) Pour Point | −1° C. | −3.9° C. |

Table II compares layered catalyst yield and viscosity index (VI) with those of Ni-ZSM-5 and exchanged Pd-ZSM-5 alone. Compared to a Ni-ZSM-5 system, the novel layered-catalyst system has essentially the same lube yield and VI. The presence of Pd in zeolite may result in a somewhat larger exotherm in a large scale adiabatic reactor.

TABLE II

Comparison of Yields and VI
Layered-Catalysts vs Ni—ZSM-5 and Pd—ZSM-5

| | Layered HDW (Ni—ZSM-5) and HDT ($Pd/Al_2O_3$) Catalyst | | Conventional HDW (Ni—ZSM-5) | 1/32" Unsteamed Pd/ZSM-5 |
|---|---|---|---|---|
| | Early Cycle | Late Cycle | | |
| Days on Stream | 0–16 | 24–36 | — | 62 |
| Yields, wt % of Charge: | | | | |
| $C_1$–$C_3$ | 2.6 | 2.3 | 3.5 | 5.5 |
| $C_4$ | 4.2 | 4.0 | 5.3 | 5.3 |
| $C_5$ | 2.8 | 3.1 | 2.2 | 2.5 |
| $C_6$-165° C. (330° F.) | 4.3 | 5.5 | 3.5 | 2.4 |
| 165–343° C. (330–650° F.) | 2.2 | 2.1 | 1.7 | 2.4 |
| 650° F.+ | 84.5 | 83.3 | 83.4 | 84.8 |
| Total | 100.6 | 100.3 | 100.6 | 100.5 |
| $H_2$ Consumption, SCF/B | 340 | 170 | 340 | 320 |
| Viscosity Index (VI) (343° C.+) | 87.7 | 87.8 | 88 | 89.5 |
| 343° C. Pour (D-97) °C. | −1° C. | −1 | −3.9 | −9.4 |

What is claimed is:

1. A continuous cascading multi-bed process for catalytic hydrodewaxing of waxy, heavy hydrocarbon fraction feedstock comprising the conversion steps of partially dewaxing the feedstock by contacting the feedstock at elevated temperature with a first catalyst bed comprising a ZSM-5 type crystalline zeolite in the presence of hydrogen;

subsequently contacting the partially dewaxed effluent from the first bed with at least one separate hydrogenation catalyst bed under hydrotreating conditions to saturate olefinic reaction products of the dewaxing step;

further catalytically dewaxing the hydrotreated feedstock in contact with ZSM-5 type catalyst in at least one additional catalytic dewaxing step; and further hydrogenating the dewaxed feedstock in an additional hydrotreating step.

2. The process of claim 1 wherein the feedstock consists essentially of a lubricant range petroleum fraction and the dewaxing catalysts consist essentially of acid nickel ZSM-5.

3. The process of claim 2 wherein the hydrogenation catalyst comprises at least one Group VIII metal.

4. The process of claim 3 wherein the hydrogenation catalyst comprises palladium on an inert support.

5. The process of claim 1 wherein all of the conversion steps are conducted in a reactor shell having alternating operatively-connected fixed beds of hydrodewaxing zeolite catalyst and hydrogenation catalyst.

6. The process of claim 5 wherein quenching hydrogen is introduced to cascaded effluent from the dewaxing steps prior to hydrotreating, thereby cooling the cascaded dewaxing effluent to hydrotreating temperature.

7. A continuous cascading multi-bed process for catalytic hydrodewaxing of waxy petroleum feedstock in a reactor shell having alternating operatively-connected beds of hydrodewaxing zeolite catalyst and hydrogenation catalyst; comprising the conversion steps of (a) partially dewaxing the feedstock by contacting the feedstock at elevated temperature wlth a first medium pore crystalline zeolite catalyst bed in the presence of hydrogen;

(b) cooling and subsequently contacting the partially dewaxed effluent from step (a) with at least one separate hydrogenation catalyst bed under hydrotreating conditions;

(c) further dewaxing the hydrotreated feedstock from step (b) in at least one additional catalytic dewaxing step whereby catalyst aging is substantially decreased; and (d) further hydrogenating the dewaxed feedstock from step (c) in an additional hydrotreating step.

8. The process of claim 7 wherein quenching hydrogen is introduced to cascaded effluent from steps (a) and (c) prior to hydrotreating, thereby cooling the cascaded dewaxing effluent to hydrotreating temperature.

9. The process of claim 7 wherein the zeolite catalyst comprises a pentasil aluminosilicate and the hydrogenation catalyst comprises a Group VIII metal.

10. The process of claim 9 wherein the zeolite catalyst consists essentially of a ZSM-5 type zeolite and the hydrogenation catalyst comprises Pd.

11. The process of claim 9 wherein at least two hydrodewaxing zones are serially connected to intermediate and final hydrotreating zones, and wherein reaction temperature is adjusted between adjacent zones by direct or indirect contact with a heat exchange medium.

12. The process of claim 7 wherein steps (a) and (c) are conducted under dewaxing conditions at about 250° to 400° C.

* * * * *